US005322531A

United States Patent [19]

Chambers

[11] Patent Number: 5,322,531

[45] Date of Patent: Jun. 21, 1994

[54] METHODS FOR MAKING ABRASIVE WHEELS

[75] Inventor: Chauncey E. Chambers, Chesterland, Ohio

[73] Assignee: Ramron-Bancroft, Inc., Dearborn, Mich.

[21] Appl. No.: 35,003

[22] Filed: Mar. 22, 1993

Related U.S. Application Data

[63] Continuation-in-part of Ser. No. 909,856, Jul. 7, 1992, Pat. No. 5,224,968.

[51] Int. Cl.[5] ..... B24D 3/00

[52] U.S. Cl. ..... 51/293; 51/298; 51/309

[58] Field of Search ..... 51/293, 298, 309

[56] References Cited

U.S. PATENT DOCUMENTS

| | | | |
|---|---|---|---|
| 3,906,684 | 9/1975 | Marshall et al. | 51/295 |
| 4,504,283 | 3/1985 | Charvat | 51/298 |
| 4,588,420 | 5/1986 | Charvat | 51/298 |

*Primary Examiner*—Mark L. Bell
*Assistant Examiner*—Willie J. Thompson
*Attorney, Agent, or Firm*—Ralph E. Jocke

[57] ABSTRACT

A method of forming abrasive grinding wheels includes the steps of preheating abrasive grains, an open circular mold and liquid epoxy binder, to a temperature below the curing temperature of the binder and at which the binder has relatively low viscosity. The binder is placed in the mold and the mold is rotated, or the mold is held stationary and grains are added from a moving delivery source. The abrasive is added along a radian with respect to an axis of the mold. The rate of the addition of the abrasive grains and the rotational speed of the mold or delivery source are controlled such that abrasive grains added during a prior rotation submerge in the binder by the time the mold or delivery source again reaches the area where more grains are added. After the binder is suitably filled with abrasive, the wheel is cured by heating and the solid mass removed from the mold and trimmed to size, removing any skin of excess binder. The method produces grinding wheels having low porosity, excellent balance and grinding characteristics. The method is suitable for use in the manufacture of super abrasive wheels as well as wheels which include conventional abrasives and fillers.

14 Claims, 5 Drawing Sheets

METHODS FOR MAKING ABRASIVE WHEELS

CROSS REFERENCE TO RELATED APPLICATION

This Application is a continuation-in-part of U.S. patent application Ser. No. 07/909,856 filed Jul. 7, 1992, now U.S. Pat. No. 5,224,968.

TECHNICAL FIELD

This invention relates to abrasive materials. Specifically, this invention relates to a method for making abrasive wheels for use as grinding or feed wheels.

BACKGROUND ART

Many types of abrasive wheels are known in the prior art. A type of abrasive wheel proven to have exceptional grinding properties is the type made with abrasive grains embedded in a plastic binder. Common plastic binders include materials such as polyurethanes and epoxies.

In the past, abrasive wheels of a plastic type have been formed by mixing together the liquid binder, abrasive grains and other materials such as fillers. Once the materials are mixed they are poured into a mold. The mixture is then heated in the mold to cure the binder and form a solid wheel. The wheel is then removed from the mold and a skin of abrasive free binder that typically forms at the open surface of the mold is removed. Once the skin is removed, the wheel is suitable for use.

The problem with the prior art approach of making abrasive wheels is that they tend to be filled with air bubbles in the interior. This characteristic is referred to as "porosity". Porosity is undesirable in a grinding wheel because it tends to score the material being ground. Porosity also tends to cause imbalance in the wheel.

It is believed that the characteristic of porosity occurs because small amounts of air are introduced during the mixing and pouring processes. The tiny air bubbles expand during curing to form significantly larger pockets inside the wheel. Various approaches have been tried over the years to eliminate porosity, however the condition has persisted in commercially available wheels.

Thus, there exists a need for a method for manufacturing abrasive wheels that reduces porosity while providing improved wheel balance and grinding characteristics.

DISCLOSURE OF INVENTION

It is object of the present invention to provide a method for making abrasive wheels that produces a wheel that has superior grinding characteristics.

It is a further object of the present invention to provide a method for making abrasive wheels that reduces porosity.

It is a further object of the present invention to provide a method for making abrasive wheels that produces wheels with a uniform distribution of abrasive grains.

It is a further object of the present invention to provide a method for making abrasive wheels that is suitable for producing wheels having a high abrasive density.

It is a further object of the present invention to provide a method for making abrasive wheels that is suitable for making wheels that are accurately balanced and suitable for use at high speeds.

Further objects of the present invention will be made apparent in the following Best Modes for Carrying Out Invention and the appended claims.

The foregoing objects are accomplished in the preferred embodiment of the invention by a method for making an abrasive wheel which involves the steps of heating abrasive grains to an elevated temperature. A circular open top mold is also is heated to generally the same elevated temperature. Finally, a liquid epoxy binder material is heated to generally the same temperature. The elevated temperature to which constituents are heated is below the curing temperature of the binder material, but sufficiently high so that the viscosity of the liquid binder is reduced from that experienced at room temperature or at temperatures that approach the temperature in which the binder cures and becomes thicker.

The binder is then introduced into the mold through the top. The mold is then rotated so that the outer surface of the material in the mold is moving at a speed from 750 to 2,650 inches per minute. The temperature of the mold and the binder therein is maintained at the elevated preheated temperature as it rotates.

The abrasive grains are then introduced into the binder through the top of the mold. Preferably, the grains are introduced along a radian extending outward from the axis of rotation of the mold. The grains are maintained at the elevated temperature until introduced into the binder. The grains are added at a rate such that the grains introduced on the prior rotation of the mold, are submerged in the binder by the time the mold again passes the location where additional grains are added.

Alternatively, the abrasive grains may be added to a stationary mold by way of a moving abrasive grain delivery source. If the abrasive grains are added to the stationary mold it may be preferable to vibrate to mold to facilitate acceptance of the grains into the binder.

Once the mold is sufficiently filled with abrasive grains, the mold is transferred to an oven wherein the wheel is heated above the curing temperature of the binder. Once cured, the wheel is removed from the mold and the skin of abrasive free binder is removed. The resulting abrasive wheel has a high abrasive density and uniformity, and low porosity.

The method of the present invention may be applied to the manufacture of various types of grinding wheels suitable for grinding diverse materials. Variations in grinding properties may be achieved by mixing filler materials of various types with the abrasive grains, and heating them prior to adding them to the liquid binder material in the mold.

BEST MODES FOR CARRYING OUT INVENTION

Figure 1:
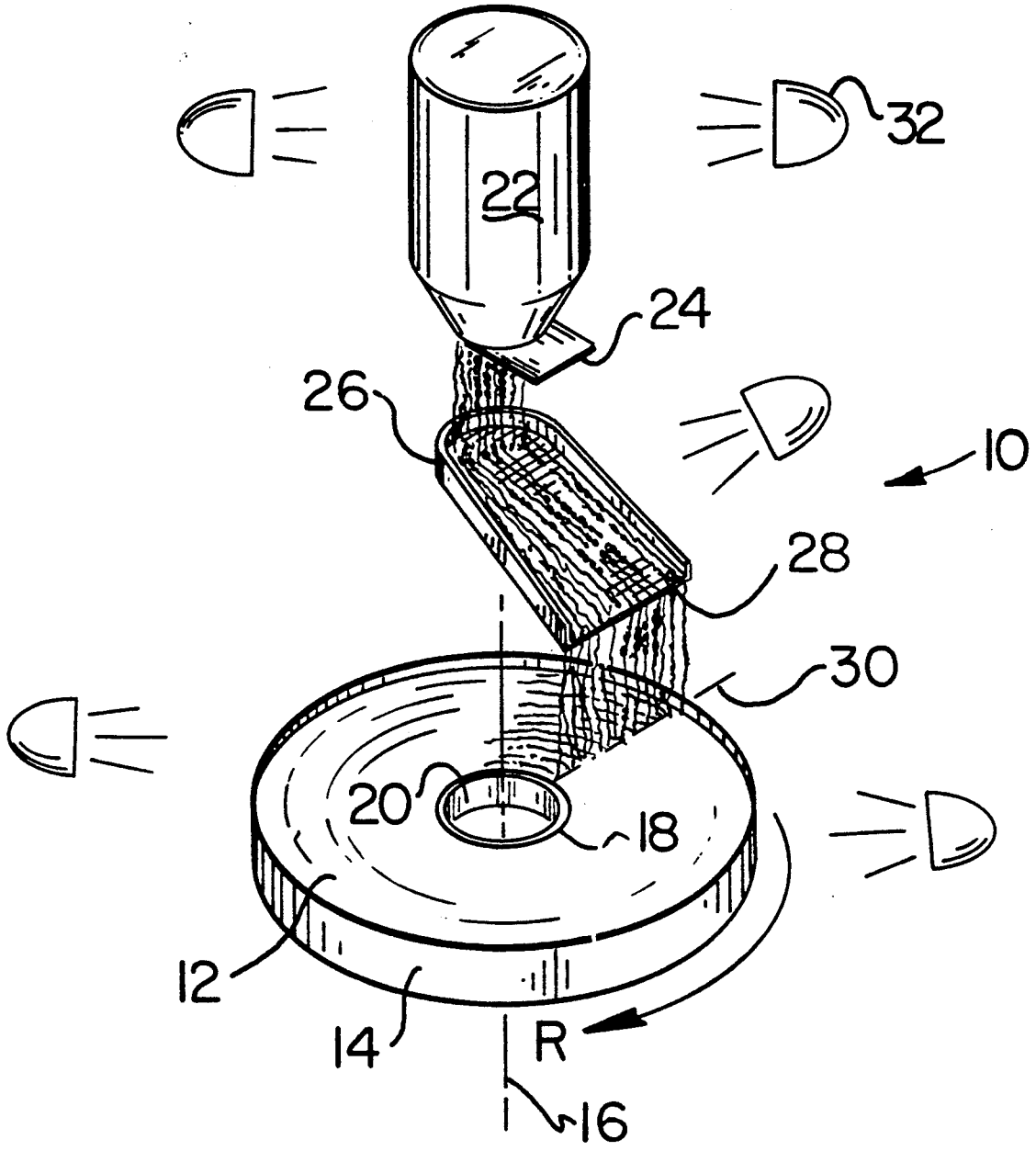
FIG. 1 is a schematic view of the apparatus used to carry out a first form of the method for manufacturing abrasive wheels of the present invention.

Referring now to the drawings and particularly to FIG. 1, there is shown therein a schematic view of the apparatus used to carry out a first form of the method of manufacturing abrasive wheels of the present invention, generally indicated 10. Apparatus 10 includes a conventional open top mold 12 which is bounded by a circular side wall 14. Wall 14 extends circumferentially about an axis 16 which extends through the center of the mold. The mold also incorporates a center liquid binder outside of a central area 20 of the wheel. The open central area 20 of the wheel enables the wheel to be mounted on a rotating shaft in the conventional manner upon completion of the manufacturing process.

The apparatus 10 further includes a holding bin 22 suitable for holding abrasive grains and filler materials commonly employed in the manufacture of grinding wheels. Bin 22 has a bottom opening (not shown) which is controlled by an adjustable slide valve 24. A fan shaped funnel 26 is positioned under the bin opening. Funnel 26 has an edge 28 which extends over a radian 30 that extends outward from the center of the mold 12. In the preferred form of the invention, the bin 22 and funnel 26 are vibrated by controlled vibrating means (not shown) to ensure the uniform flow of abrasive material therethrough.

Apparatus 10 for carrying out the method of the present invention includes heaters schematically indicated 32 for heating the bin 22, funnel 26 and mold 12. The heaters are capable of maintaining the apparatus at an elevated temperature in the range of 150 to 200 degrees Fahrenheit. The apparatus also includes a turntable or other rotating device (not shown) suitable for rotating mold 12 about axis 16 in the direction of Arrow R.

Figure 2:
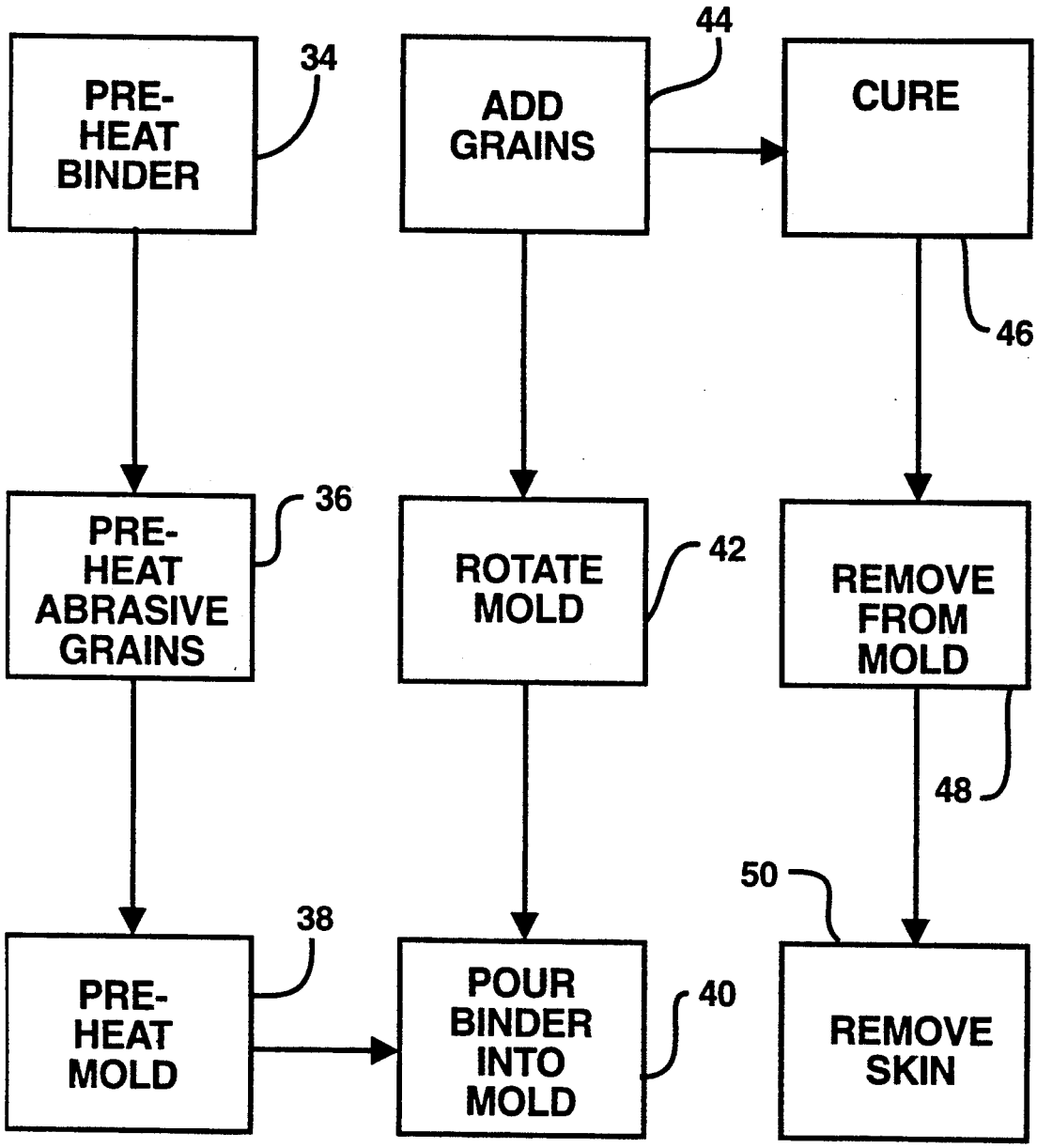
FIG. 2 is a schematic view of the process steps used in manufacturing a first abrasive wheel in accordance with the method of the present invention.

Abrasive wheels are made in accordance with the method steps shown schematically in FIG. 2. A liquid epoxy or other plastic type binder material is preheated to an elevated temperature at step 24. The temperature to which the binder material is preheated is below the curing temperature of the binder material, but is a temperature at which the binder has a lower viscosity than at room temperature. In the preferred form of the invention, Applicant has found that for most liquid epoxy binders, temperatures in the range of 150 to 200 degrees Fahrenheit produce a suitable viscosity.

Abrasive grains of suitable size and material for the type of abrasive wheel to be manufactured in accordance with the method, are preheated to about the same temperature as the binder in a step 36. This can be done by heating the grains in the bin 22 or by heating them in an oven and then transferring them to the heated bin.

The mold 12 is also preheated to about the temperature of the binder and the grains at a step 38. It should be pointed out that the steps of heating the grains, binder and mold can be carried out in any order, or preferably simultaneously to save time.

The heated liquid binder material is then poured into the top of the mold at step 40. Mold 12 is then rotated at a step 42 in the direction of Arrow R shown in FIG. 1. As the mold 12 rotates, slide valve 24 on bin 22 is opened so that abrasive grains flow out of the bin, down funnel 26 and into the binder along radian 20. The speed of rotation of the mold and the rate of adding the grains are controlled so that the grains added along radian 20 are submerged in the liquid binder by the time the mold has again rotated to the location of radian 30. This ensures that each grain of abrasive material is sufficiently surrounded by the liquid binder material and is disposed from other grains. This enables each grain to achieve slight movement under loading during grinding and prevents grain tear out.

Applicant has found that for most abrasive wheels in the range of 12 inches to 42 inches in diameter, a rotational speed for the mold at which the side wall 14 moves at rates from 750 inches per minute to 2,650 inches per minute are suitable, provided that the character of the binder and the grains submerge within one rotation of the mold. Although in the preferred embodiment of the apparatus 10 shown in FIG. 1, the abrasive grains are only added along one radian, the method of the present invention may be applied to apparatus adding abrasive grains along several radians. Of course, using such apparatus the speed of the rotating mold must be adjusted accordingly so that previously added grains are submerged before additional grains are added. In the method of making the wheel of the present invention, sufficient abrasive grains are added to fill the mold to its entire height of the desired wheel and slightly more. This is done as shown in FIG. 2 at step 44.

Under certain circumstances, the abrasive material tends to "float" on top of the binder. To wet the abrasive and submerge it in the binder material a wiper type blade or tines are positioned above the mold to push the abrasive into the binder as the mold rotates.

After the abrasive grains are added, the mold and liquid binder/abrasive combination are transferred to a curing oven wherein the temperature is elevated above the curing temperature of the binder. This is done at a step 46. After the wheel is cured it becomes a solid mass. The wheel is then removed from the oven and allowed to cool until it can be removed from the mold at a step 48.

As the wheel is cured, a skin of abrasive free binder is usually formed on the top of the mold. This skin is removed in a step 50 using a cutting tool. The cutting tool usually employs a diamond or silicon carbide tip and is used to trim the wheel to its final size.

A first example of a wheel that may be manufactured in accordance with the method of steps 34 through 50, comprises an epoxy binder called E-100 Thermopoxy available from the Reichold Chemical Company. This binder material exhibits reduced viscosity in an optimum extent at approximately 180 degrees Fahrenheit. This facilitates the acceptance of abrasive grains. The material cures at approximately 350 degrees Fahrenheit.

A first example of a grinding wheel is made approximately 14 inches in outside diameter with a central area roughly five inches in diameter. The wheel is approximately eight inches wide. This wheel may be cured in approximately eight hours at 350 degrees Fahrenheit. Applicant has found that as a rule of thumb roughly one hour of curing time is required for each inch of wheel width.

An abrasive material suitable for use in the wheel of this first example, made in accordance with steps 34 through 50, has abrasive grains of aluminum oxide of generally 100 mesh and a bulk density of 3.95 grams per cubic centimeter. The wheel of this example is roughly 8 inches wide but is filled with abrasive to approximately 8.25 inches prior to curing. The 14 inch diameter wheel of this example is rotated at about 20 rpm as the grains are added along one radian.

After curing, the wheel is then trimmed to remove the skin as well as to bring the wheel to its final size. The wheel manufactured in accordance with this method is a hard dense wheel with virtually no porosity. It is suitable for use in high pressure steel grinding applications for use as a feed wheel for feeding stock of softer metals. Because this epoxy binder has a tensile strength of at least 6,000 PSI, the wheel is very strong and resists tear out of the grains during high impact grinding. This provides for superior performance and long life.

When tungsten and other somewhat harder materials are to be ground, a less dense abrasive wheel than that described in example 1 above may be desired. A wheel more suitable for grinding in such applications is made by including fillers in the wheel with the abrasive grains. Applicant has found that a suitable filler material for use in such wheels are hollow spheres of aluminum oxide known as Duralum AB made by the Washington Mills Abrasive Company.

Figure 3:
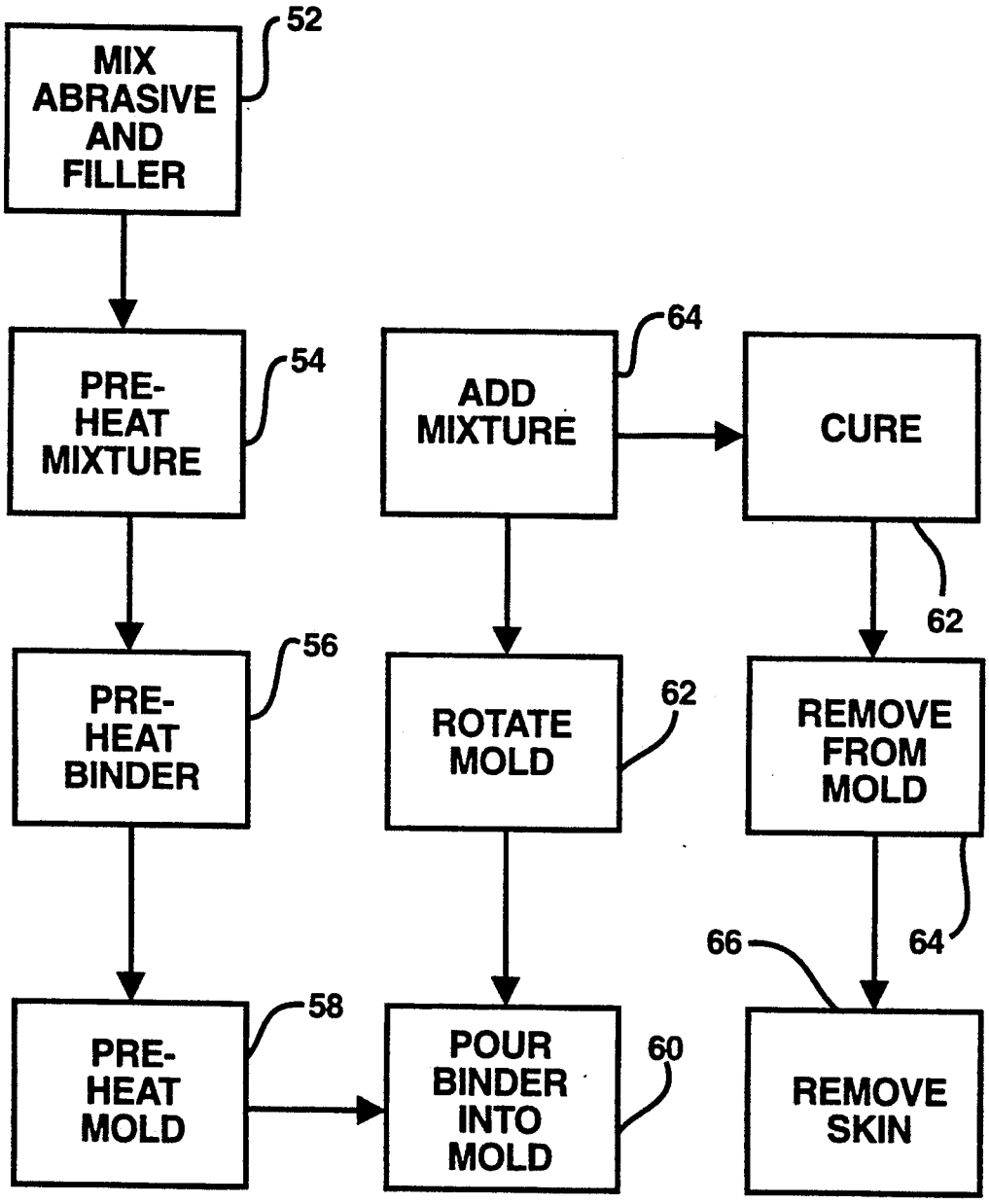
FIG. 3 is a schematic view of the process steps used in manufacturing a second abrasive wheel in accordance with the method of the present invention.

In the second example now described, a wheel having a 42 inch outside diameter, a 20 inch inside diameter and three inch thickness is made. Small size 36 F Duralum AB are first mixed with abrasive grains as indicated in step 52 as shown in FIG. 3. The abrasive grains are themselves a mixture of 30 mesh, high friable white aluminum oxide and 30 mesh brown, aluminum oxide abrasive. In the preferred embodiment, the abrasive is of the type commercially available from the Elfusa Company of Brazil. These abrasives are mixed one part of the first abrasive to one part of the second abrasive by weight respectively. These mixed abrasive grains are then mixed with the filler material at the rate of 292 parts of abrasive to six parts of filler by weight.

After the abrasive grains and filler are mixed they are preheated at a step 54 and placed in bin 22 wherein they are maintained in a range of 150 to 200 degrees Fahrenheit.

The liquid binder material is then preheated at a step 56 previously described. However, in the second example a binder known as Epotuf Epoxy Resin 37-140 made by the Reichold Chemical Company is used. This epoxy is mixed with a hardener known as number 37-670 also manufactured Reichold Chemical Company. The hardener is added to the resin at the rate of 100 parts resin to 25 parts hardener by weight. The binder and hardener are thoroughly mixed in the heated condition and ideally held at a temperature of 150 to 180 degrees Fahrenheit.

The mold is preheated to generally the temperature of 180 to 200 degrees Fahrenheit at a step 58. The liquid binder is then poured into the mold in a step 60, and rotation of the mold begun in step 62. The mixture of abrasive grains and filler is introduced to the liquid binder in the mold at step 64 in the manner previously described. The mixture is added along radian 30 and the rate of addition of mixture and the speed of mold rotation are adjusted so that the abrasive/filler mixture added upon each rotation of the mold submerges in the binder before the mold again rotates and further material is added. Although the hollow spheres of filler material are lighter than the abrasive grains, the addition of the grains on top of the spheres aids in submerging the filler spheres uniformly in the binder and prevents them from separating. Wetting of the binder and filler can be accelerated using a wiper blade or tines as previously described.

Once the binder in the mold is filled with the abrasive/filler mixture, it is transferred to a curing oven and cured in the step 62. The curing temperature for the binder in this second example is about 200 degrees Fahrenheit for three hours and then 350 degrees for four hours.

After curing, the solid wheel is cooled until it can be removed from the mold at a step 64. The abrasive free skin of material is then cut away at a step 66.

The grinding wheel described in the second example produces a low porosity wheel suitable for grinding hard steels. The wheel produces an excellent grinding finish due to the low porosity and uniform density. Applicant has found that wheels up to 42 inches in diameter made in accordance with this method provide excellent grinding characteristics. Also, because the binding material used in this second example has an even higher tensile strength than the binder described in the first example, the resistance to grain tear out and impact absorption of the grains provides superior wheel life.

An alternative method is described with reference to the apparatus shown in FIG. 4. An apparatus 68 shown schematically, includes an open top mold 70 which is similar to mold 12. The mold is supported on a table surface 72. Surface 72 is mechanically vibrated by vibrators 74. The vibrators serve to vibrate the surface and the mold in the vertical direction.

The apparatus 68 further includes a bin 76 for holding a supply of abrasive grains or a mixture of abrasive grains and binder. The bin 76 discharges through an opening 78 into a funnel 80. Opening 78 is controllable by means of a slide valve (not shown) to regulate the rate of flow of material from the bin through the opening.

The bin 76 and funnel 80 are parts of an assembly, and are moved by a mechanism in a circular path over the mold indicated by the Arrows M. The movement of the funnel and bin is such that the edge of the funnel extends radially outward over the mold at all times during its rotation.

Figure 4:
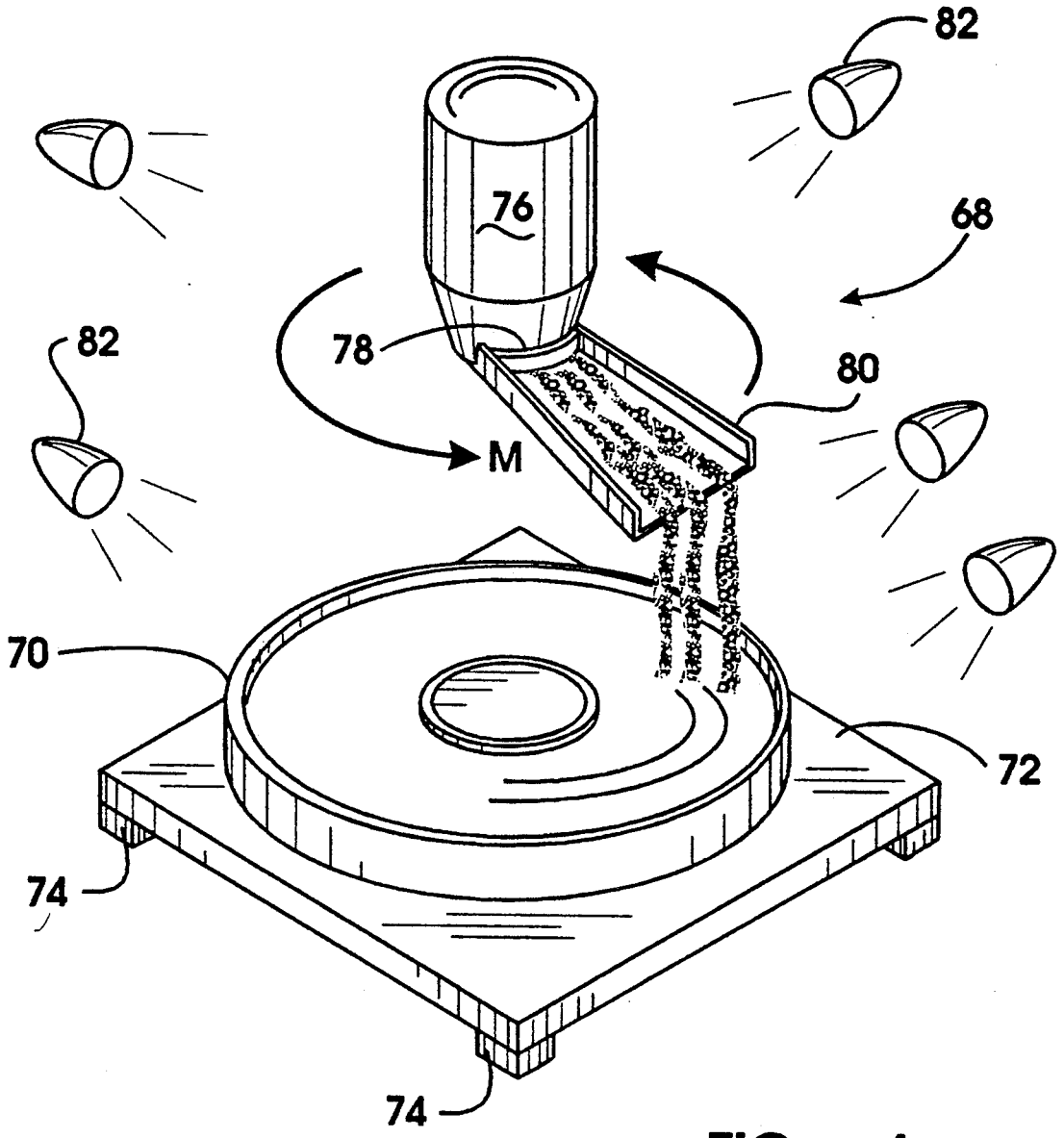
FIG. 4 is a schematic view of an apparatus used to carry out a first alternative form of the method for manufacturing abrasive wheels of the present invention.

In the alternative method used with the apparatus of FIG. 4, the abrasive grains or a mixture of abrasive grains and fillers are preheated and placed in bin 76. The liquid binder and the mold 70 are similarly preheated. The binder is then placed in the mold. The elevated temperature is maintained by heaters 82.

Abrasive grains (or a mixture of abrasive and fillers) are passed out of bin 76, through opening 78 and down funnel 80. This is done as the bin and funnel are traveling above the mold. The rotational speed of the bin and funnel assembly which serves as the grain delivery source, is controlled so that the material deposited in the binder on the preceding pass is accepted into the binder by the time of the next subsequent pass.

As the abrasive or abrasive and filler mixture is introduced into the binder, the surface 72 which supports the mold may be vibrated by vibrators 74. This facilitates acceptance of the abrasive into the binder. In some situations the abrasive or abrasive and filler mixture may be readily accepted in the binder without vibration. However, if the abrasive and filler mixture tends to float on the binder, vibration and/or a rotating wiper or tines may be used to help "push" the material into the binder.

Once the mold is filled with the abrasive or abrasive and filler mixture, the wheel is cured, removed from the mold and the binder free skin removed in the manner of the previously described method.

Figure 5:
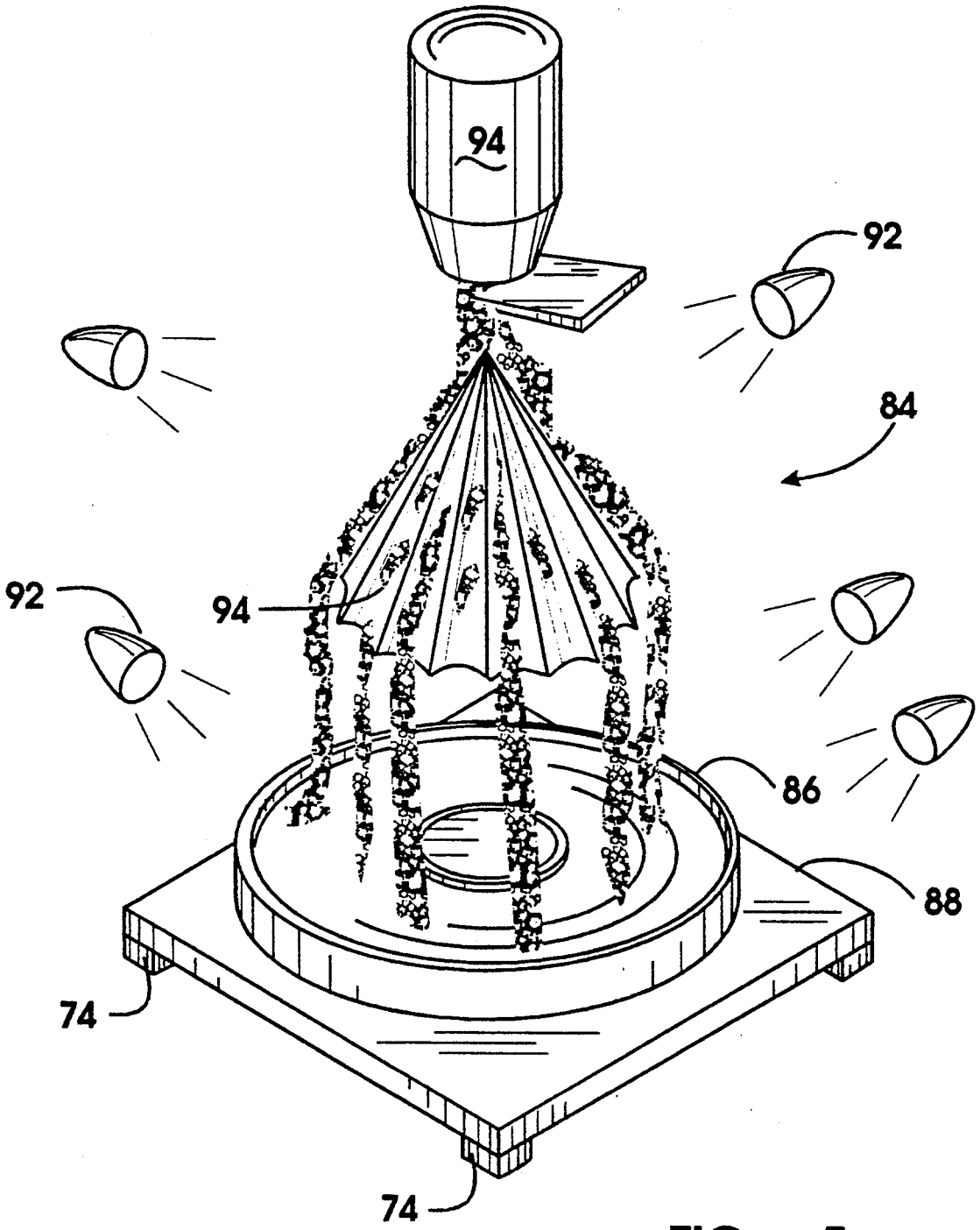
FIG. 5 is a schematic view of an apparatus used to carry out a second alternative form of the method for manufacturing abrasive wheels of the present invention.

A further alternative method is described with respect to the apparatus 84 shown schematically in FIG. 5. The apparatus has an open top mold 86 supported on a surface 88 which is vibrated by vibrators 90. The apparatus is maintained at elevated temperature by heaters 92.

The apparatus 84 includes a bin 94 with a controllable opening in the bottom. The bin is positioned vertically above an umbrella type baffle 94. The baffle 94 is conical in shape and is made of mylar or other suitable material. The baffle can be expanded and retracted so as to vary the diameter of its bottom area, as reflected by the dashed lines.

In operation, the binder and abrasive or mixture of abrasive and filler is heated, along with the mold. The binder is placed in the mold. While the mold is vibrated on surface 88, abrasive or a mixture from bin 94 is distributed by passage over baffle 94, and is deposited into the binder.

As the abrasive or mixture is added, the baffle is periodically expanded and contracted to distribute the material into the binder. Because the material from the bin is distributed into the mold from the surface at the lower circumference of the baffle, the timing for opening and closing the baffle (or the flow rate out of bin, or both) is controlled to obtain a uniform distribution in the mold. In this method, as in the others, a rotating wiper or tines may be used to facilitate acceptance of the abrasive material into the binder. Also, in some circumstances, vibration of the mold may not be required to achieve acceptance of the abrasive grains, or abrasive grains and filler mixture into the binder.

Once the mold is filled, the wheel is cured. The wheel is removed from the mold, the skin is then removed in the manner previously discussed to complete the manufacture of the abrasive wheel.

An advantage of the methods of the present invention is that they produce not only a low porosity wheel, but also wheels of high uniform density and balance. This aids in making the wheel suitable for use in high speed grinding applications. Applicant has also found that the methods of the present invention are particularly suitable for making grinding wheels which include super abrasives such as coated natural and synthetic diamonds as well as conventional abrasive grains. When diamonds are used in the wheel, silicon carbide bodies may be used as a filler. Of course, any combination of abrasive grains and filler materials may be used to manufacture abrasive wheels using the method of the present invention.

Thus, the methods of manufacturing abrasive wheels of the present invention achieves the above stated objectives, eliminates difficulties encountered in the use of prior methods, solves problems and attains the desirable results described herein.

In the foregoing description certain terms have been used for brevity, clarity and understanding, however no unnecessary limitations are to be implied therefrom because such terms are for descriptive purposes and are intended to be broadly construed. Moreover, the descriptions and illustrations presented herein are examples and the invention is not limited to the exact details shown or described.

Having described the features, discoveries and principles of the invention, the manner in which it is carried out and operated, and the advantages and useful results obtained; the new and useful structures, devices, elements, arrangements, parts, combinations, systems, equipment, operations, methods and relationships are set forth in the appended claims.

I claim:

1. A method for manufacturing an abrasive wheel comprising the steps of:

preheating abrasive grains, liquid binder material, and a mold, said mold having an open top, closed bottom and a circular side wall extending generally parallel with respect of a vertical axis, to an elevated temperature below the curing temperature of said liquid binder material and in which said binder material exhibits reduced viscosity;

placing said binder material in said mold;

maintaining said mold, binder material and abrasive grains at said elevated temperature while:

adding said abrasive grains to said binder material through the top of said mold from a moving grain delivery source; and heating said mold and said contained binder and abrasive grains to cure said binder.

2. The method according to claim 1 and further comprising the step of vibrating said mold as said grains are added to said binder.

3. The method according to claim 1 wherein said abrasive grain delivery source moves in a circular path over said mold.

4. The method according to claim 2 wherein said abrasive grain delivery source is moved in a circular path over said mold.

5. The method according to claim 4 wherein said abrasive grain delivery source deposits said grains along a line that extends radially with respect to said mold, and wherein said delivery source is rotated at a speed and said grains are added at a rate wherein said abrasive grains at a location submerge in said binder before said delivery source again rotates past said location and additional grains are added to said binder at said location.

6. The method according to claim 5 and further comprising the steps of:

mixing particles of filler material with said abrasive grains, and preheating said particles and grains; and then introducing said mixed grains and particles to said binder material.

7. The method according to claim 6 wherein said abrasive grains consist essentially of aluminum oxide.

8. The method according to claim 6 wherein said filler material consists essentially of hollow spheres of aluminum oxide.

9. The method according to claim 6 wherein said abrasive grains consist essentially of diamond.

10. The method according to claim 1 and further comprising the step of pushing said grains and filler material into said binder with moving pushing means above said binder, said grains and filler material being pushed into said binder as said pushing means moves.

11. The method according to claim 2 and further comprising the step of pushing said grains and filler material into said, binder with moving pushing means above said binder, said grains and filler material being pushed into said binder as said pushing means moves.

12. A method for manufacturing an abrasive wheel comprising the steps of:

preheating abrasive grains, liquid binder material, and a mold, said mold having an open top, closed bottom and a circular side wall extending generally parallel with respect of a vertical axis, to an elevated temperature below the curing temperature of said liquid binder material and in which said binder material exhibits reduced viscosity;

placing said binder material in said mold;

maintaining said mold, binder material and abrasive grains at said elevated temperature while adding said abrasive grains to said binder material through the top of said mold; and heating said mold and said contained binder and abrasive grains to cure said binder.

13. The method according to claim 12 wherein said abrasive grains are added to said binder in at least one location, said location moving rotatably with respect to said axis.

14. The method according to claim 12 wherein said abrasive grains are added to said binder in at least one location, said location extending arcuately and coaxially with said axis.

* * * * *